US006146098A

United States Patent [19]

Fukuno et al.

[11] Patent Number: 6,146,098

[45] Date of Patent: Nov. 14, 2000

[54] TIP SHROUD FOR COOLED BLADE OF GAS TURBINE

[75] Inventors: Hiroki Fukuno; Yasuoki Tomita; Eisaku Ito, all of Takasago, Japan

[73] Assignee: Mitsubishi Heavy Industries, Ltd., Tokyo, Japan

[21] Appl. No.: 09/242,678

[22] PCT Filed: Jun. 18, 1998

[86] PCT No.: PCT/JP98/02689

§ 371 Date: Feb. 22, 1999

§ 102(e) Date: Feb. 22, 1999

[87] PCT Pub. No.: WO98/59157

PCT Pub. Date: Dec. 30, 1998

[30] Foreign Application Priority Data

Jun. 23, 1997 [JP] Japan ..... 9-165917

[51] Int. Cl.[7] ..... B63H 1/14

[52] U.S. Cl. ..... 416/97 R; 416/191

[58] Field of Search ..... 416/97 R, 96 A, 416/191, 192

[56] References Cited

U.S. PATENT DOCUMENTS 5,460,486 10/1995 Evans et al. ..... 416/97
5,482,435 1/1996 Dorris et al. ..... 416/97
5,785,496 7/1998 Tomita ..... 416/97 R

FOREIGN PATENT DOCUMENTS 47-35405 11/1972 Japan .
7-42504 2/1995 Japan .
8-200002 8/1996 Japan .

*Primary Examiner*—Edward K. Look
*Assistant Examiner*—Hermes Rodriguez
*Attorney, Agent, or Firm*—Wenderoth, Lind & Ponack, L.L.P.

[57] ABSTRACT

A tip shroud for a moving blade that is made thin and light for use at a gas turbine downstream stage. Cooling air holes (13 to 16) having a slot shape, are formed in a tip shroud (11) of the moving blade (10). The cooling holes are opened in two side faces of the tip shroud to release the cooling air from the inside of the moving blade (10). In the upper face of the tip shroud 11, there are formed cooling air holes 20, which communicate with the higher pressure side in a combustion gas flow direction R to release the cooling air so that the cooling air flows from the higher pressure side to the lower pressure side so as to cool a high stress portion Y. A high stress portion X is likewise cooled with the cooling air coming from an adjoining moving blade. The slot shapes of the cooling air holes (13 to 16) allow the cooling air to flow widely, thereby cooling the face of the tip shroud (11), and the cooling air holes 20 cool the high stress portions X and Y effectively.

5 Claims, 9 Drawing Sheets

TIP SHROUD FOR COOLED BLADE OF GAS TURBINE

TECHNICAL FIELD

The present invention relates to a gas turbine cooled blade tip shroud and, more particularly, to a tip shroud for a moving blade, which is made light at a downstream stage of the gas turbine and which is cooled not only from its inside but also from its outside.

DESCRIPTION OF RELATED ART

In recent years, the gas turbine has advanced to have elongated moving blades that are subjected to higher temperatures and output. Especially a downstream stage moving blade is remarkably elongated to 50 to 60 cm, for example. This long moving blade has a large weight and accordingly a serious vibration so that the stress to be generated by the centrifugal force at the time of rotation becomes far higher than that of the prior art. Therefore, this moving blade is thinned as much as possible so that it may be lighter, and its width is tapered to grow smaller toward the end portion.

FIGS. 6(*a*)–(*b*) show an example of the prior art moving blade, FIG. 6(*a*) is a longitudinal section, and FIG. 6(*b*) is a section taken along line D—D of FIG. 6(*a*). In FIG. 6(*a*), reference numeral 50 designates a moving blade having a blade root 51 and a hub 53. Numeral 54 designates a hub which has a cavity 55 therein as long as 25% of the blade length. Numeral 56 designates a number of pin fins protruding inward of the cavity 55 or connected to the two opposing cavity walls. Numeral 57 designates core supporting ribs. Numeral 58 designates holes for feeding cooling air. These holes 58 are arrayed in a large number from the portion of the 25% blade length, as shown in FIG. 6(*b*), and extend to a blade end 59. Numeral 60 designates a tip shroud at the leading end.

FIGS. 7(*a*)–(*b*) show the tip shroud, FIG. 7(*a*) is a view taken in the direction of arrows E—E of FIG. 6(*a*), and FIG. 7(*b*) is a view taken in the direction of arrows F—F of FIG. 7(*a*). In FIG. 7(*a*), numeral 61 designates a number of air passages formed along the inner face of the tip shroud 60 and having openings 62. In the moving blade thus constructed, the cooling air from the blade root 51 enters the cavity 55 so that it is disturbed by the pin fins 56 into a turbulent state to cool the hub 54 in an enhanced cooling effect. Then, the cooling air flows through the holes 58 into the air passages 61 of the tip shroud 60 while cooling the blade and cooling the tip shroud 60 from the inside until the air is finally released from right and left openings 62 to the combustion gas passage.

FIG. 8 shows an improvement over the aforementioned moving blade 50 shown in FIGS. 6 and 7. In this example of the moving blade, the work of boring the holes is eliminated to improve the workability, and the porosity is improved to improve the cooling efficiency, as has been applied for patent by the Applicant. In FIG. 8, numeral 40 designates a moving blade having a blade root 41 and a hub 42. This moving blade 40 has a cavity which is supported by a number of core supporting ribs 43 extending in the longitudinal direction of the blade. On the inner wall of the cavity, on the other hand, there are provided multiple stages of oblique turbulators 44. FIG. 9 is a section taken along line G—G of FIG. 8 and shows the oblique turbulators 44 which protrude from the inner wall for disturbing the inflows of the cooling air to enhance the cooling efficiency. Numeral 45 designates openings which are formed in the front and back of a tip shroud 46 at the leading end to provide exits for the cooling air. The numeral 46 designates the tip shroud at the leading end.

In the moving blade thus constructed, the cooling air 30 flows from below the blade root 41 into the moving blade 40 toward the leading end of the cavity. In this course, the cooling air 30 is disturbed by the oblique turbulators 44 to enhance its cooling effect which extracts the heat in the inside of the moving blade 40 until the air finally flows from the openings 45 at the leading end of the tip shroud 46 to the combustion gas passage. Here, the tip shroud 46 is similar to that shown in FIG. 7, and its description will be omitted.

FIGS. 10 and 11 show an improvement over the moving blade 50 of the prior art shown in FIGS. 6 and 7. The work of boring the holes are eliminated to improve the workability and the porosity. The example shown in FIG. 10 is also directed to the moving blade of the prior art, as applied for patent by the Applicant. FIG. 10 is a longitudinal section of the moving blade, and FIG. 11 is a section taken along line H—H of FIG. 10. In these Figures, numeral 30 designates a moving blade having a blade root 31 and a hub 32. A cavity is formed in the moving blade 30 and is supported by core supporting ribs 33. Numeral 34 designates a number of pin fins formed in the interior of the cavity. These fins 34 are connected between the two walls of the cavity, as shown in FIG. 11, to disturb the flow of the cooling air like the oblique turbulators 44 provided on the moving blade 40 shown in FIGS. 8 and 9 and to increase the heat transfer area thereby enhancing the cooling efficiency.

In the moving blade thus constructed, while flowing from below the blade root 31 into the cavity of the moving blade 30 and toward the leading end, the cooling air 30 is disturbed by the pin fins 34 so as to extract the heat from the pin fins 34 thereby cooling the interior of the blade, until the air finally flows out of the leading end. Here, a tip shroud 36 has a structure similar to that of FIG. 7, and its description will be omitted.

In the moving blade of the prior art, now made thin and light and disposed at a gas turbine downstream stage, the pin fins are provided in the cavity up to a 25% height from the blade root, and the holes are provided from the 25% height to the tip shroud, so that the cooling air fed from the blade root flows to the leading end portion, while cooling the blade interior, to the leading end portion to cool the inner faces of the tip shroud at the leading end until the air finally flows out to the combustion gas passage from the openings formed in the front and rear side faces of the tip shroud.

In the moving blade of the prior art, which is improved from the aforementioned multiple hole type moving blade, on the other hand, only the oblique turbulators are provided on the inner wall of the cavity of the moving blade, or only the pin fins are arrayed. In this construction, the cooling air is also fed from the blade root to cool the inside and the inner face of the tip shroud until it finally flows out to the combustion gas passage from the openings in the side face.

In the moving blades of or according to the prior art thus far described, however, the tip shroud is cooled, but its high stress portions (i.e., the X and Y portions shown in FIG. 7(*a*)) are not sufficiently cooled, although they especially need the cooling. However, the air holes cannot be formed in those portions so as to avoid the stress concentration.

Thus, the portions are bottlenecks against the cooling operation because they cannot be cooled by feeding them directly with the cooling air.

SUMMARY OF THE INVENTION

It is, therefore, a first object of the invention to provide a tip shroud for a thinned and lightened moving blade at a downstream stage of a gas turbine, the cooling effect of which is enhanced by improving the openings for cooling air to flow out of the two side faces thereof.

A second object of the invention is to provide a tip shroud for a thinned and lightened moving blade at a downstream stage of a gas turbine, in which cooling air holes are provided for feeding, especially at the high stress portions, the cooling air to cool the tip shroud efficiently.

A third object of the invention is to provide a gas turbine cooled blade tip shroud which can be cooled efficiently in its entirety by feeding the cooling air all over the surface thereof, especially its high stress portions.

In order to solve the above-specified first to third objects, according to the invention, there are respectively provided the following means (1) to (3).

(1) A gas turbine cooled blade tip shroud mounted on the leading end of a moving blade and having a plurality of cooling air holes in two side faces for receiving cooling air to flow in the moving blade from the blade root to the leading end portion and for releasing the cooling air from the cooling air holes. The cooling air holes are formed into a slot shape along the face of the tip shroud.

(2) A gas turbine cooled blade tip shroud mounted on the leading end of a moving blade and having a plurality of cooling air holes in two side faces for receiving cooling air to flow in the moving blade from the blade root to the leading end portion and for releasing the cooling air from the cooling air holes. The cooling air holes, which are opened in the upper face of the tip shroud and communicate with the inside of the moving blade, are positioned on the higher pressure side of a combustion gas passage.

(3) A gas turbine cooled blade tip shroud in which the cooling air holes in the two side faces are formed into a slot shape along the face of the tip shroud.

In the means (1) of the invention, the cooling air holes in the two side faces of the tip shroud are formed into such a slot shape so as to have a larger passage area than that of the circular holes of the prior art so that more cooling air can be fed over a wide area to enhance the cooling effect of the tip shroud.

In the means (2) of the invention, the cooling air holes are opened in the upper face of the tip shroud on the higher pressure side of the combustion gas passage so that the cooling air, having flown from the inside of the moving blade to the upper face of the tip shroud, will flow along the upper face to the lower pressure side. At the two circumferential end portions of the tip shroud, there are curved peripheral portions, at which the high stress due to the heat is especially concentrated to especially require the cooling treatment. However, these portions cannot be bored because the cooling air holes, if formed, are likely to cause the stress concentration. According to the means (2) of the invention, the cooling air flows along the shroud upper face from the higher pressure side to the lower pressure side due to the pressure difference. In this flowing process, the curved high stress portions can be cooled with the cooling air without forming any hole.

In the means (3) of the invention, the cooling air holes in the two side faces of the shroud are formed into the slot shape, and the cooling air holes are also formed on the higher pressure side in the upper face of the tip shroud so that the two functions of the means (1) and (2) of the invention can be performed to cool the whole face of the tip shroud effectively.

DETAILED DESCRIPTION OF THE INVENTION

Figure 1:
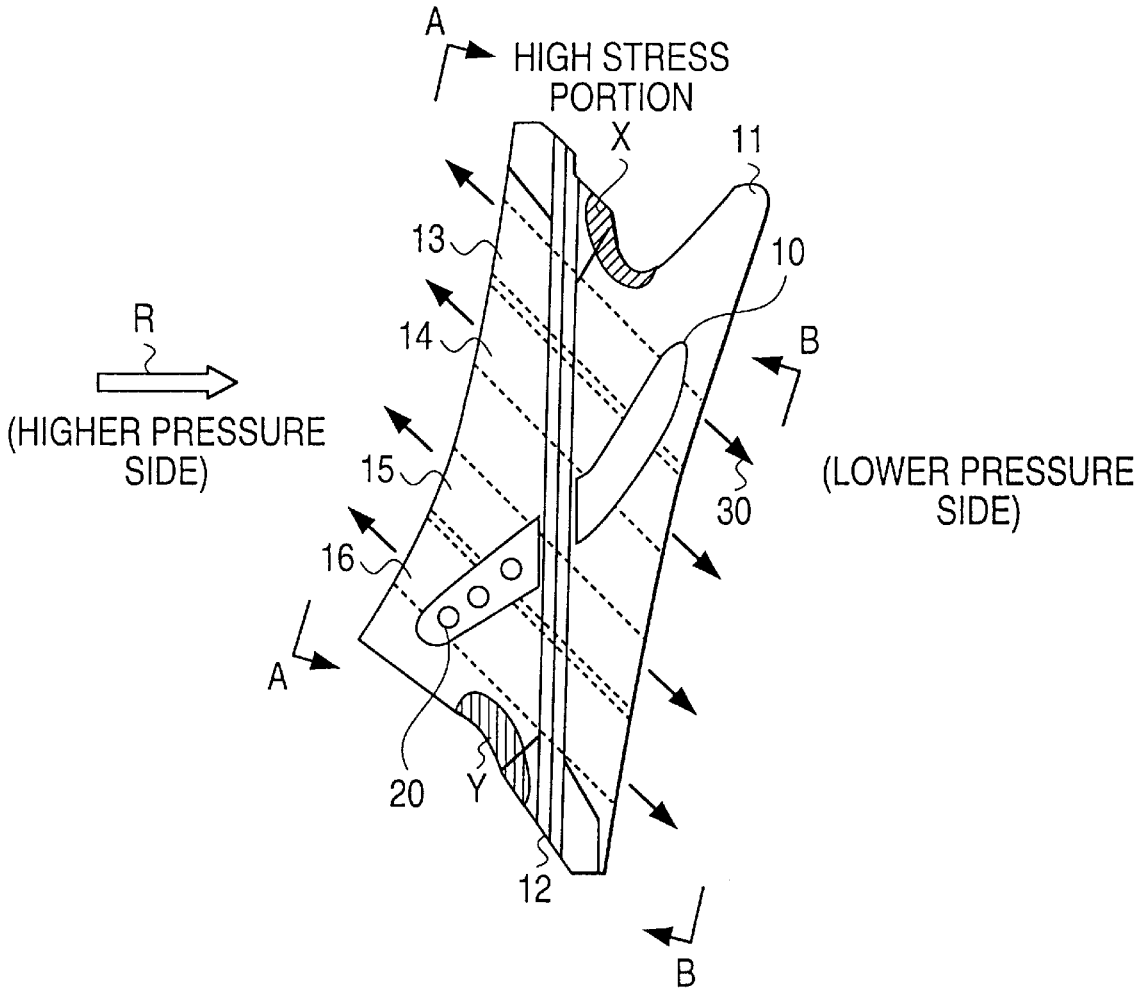
FIG. 1 is a top plan view of a gas turbine cooled blade tip shroud according to one embodiment of the invention.
Figure 2:
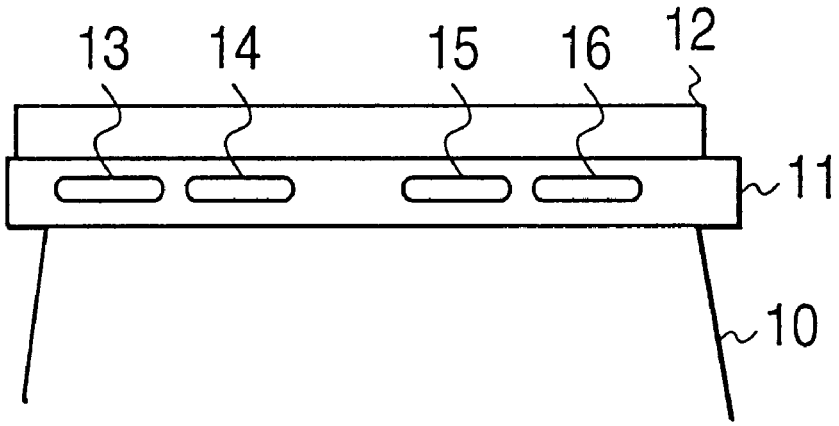
FIG. 2 is a view taken in the direction of arrows A—A of FIG. 1.
Figure 3:
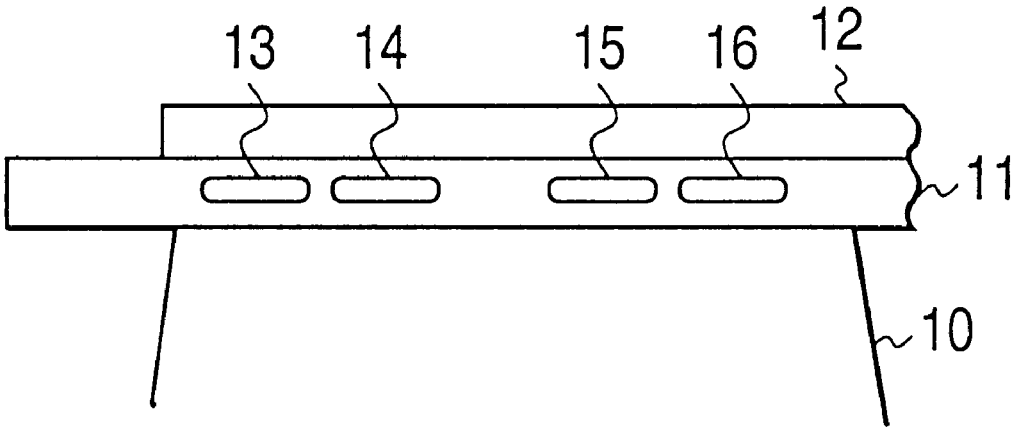
FIG. 3 is a view taken in the direction of arrows B—B of FIG. 1.

An embodiment of the invention will be specifically described with reference to the accompanying drawings. FIG. 1 is a top plan view of a gas turbine cooled blade tip shroud according to one embodiment of the invention. FIG. 2 is a view taken in the direction of arrows A—A of FIG. 1, and FIG. 3 is a view taken in the direction of arrows B—B. In FIG. 2: reference numeral 10 designates a moving blade; numeral 11 designates a tip shroud at the leading end portion of the moving blade 10; and numeral 12 designates an upper fin. Numerals 13, 14, 15 and 16 designate cooling air holes opened in the two side faces of the tip shroud 11. Each of the air holes 13–16 has a elongated slot or elliptical shape, as will be described hereinafter. In the tip shroud 11, there are formed passages which are as wide as the cooling air holes 13 to 16. Numeral 20 designates cooling air holes which are formed in the upper face of the moving blade 10, as located on the higher pressure side (or upstream side) in a combustion gas flow direction R with respect to the fin 12 of the tip shroud 11, for releasing the cooling air from the inside of the moving blade 10.

FIG. 2 is a view taken in the direction of arrows A—A of FIG. 1 and shows an arrangement of the cooling air holes 13 to 16, as located on the upstream side in the combustion gas flow direction R. As shown, the cooling air holes 13 to 16 are shaped into such a slot so as to have a wider passage area than that of the simple circular holes of the prior art and a wider area of the tip shroud 11 to allow the cooling air to pass thereby to enhance the cooling effect. Here, these cooling air holes 13 to 16 are exemplified by the slot shape but may be made elliptical.

FIG. 3 is a view taken in the direction of arrows B—B of FIG. 1 and shows the downstream cooling air holes 13 to 16 in the combustion gas flow direction R, and their arrangement is similar to that of FIG. 2. The cooling air 30 thus having flown from the moving blade 10 to the leading end flows to the two ends of the tip shroud 11 and has a wide passage so that it can cool the face of the tip shroud 11 effectively.

Figure 6A:
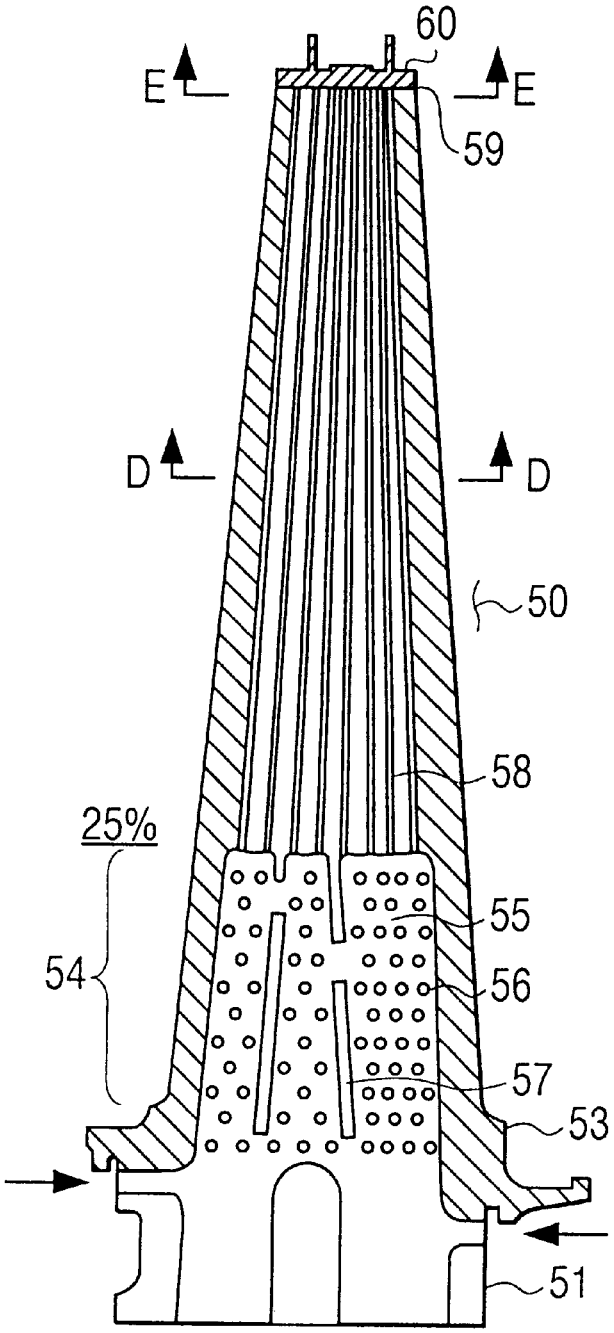
FIG. 6(a) (PRIOR ART)
FIGS. 6(*a*)–6(*b*) show an example of a prior art gas turbine moving blade provided with pin fins and multi-holes, FIG. 6(*a*) is a longitudinal section, and FIG. 6(*b*) is a section taken in the direction of arrows D—D of FIG. 6(*a*)
Figure 6B:
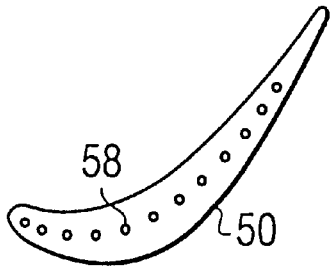
FIG. 6(b) (PRIOR ART)
Figure 7A:
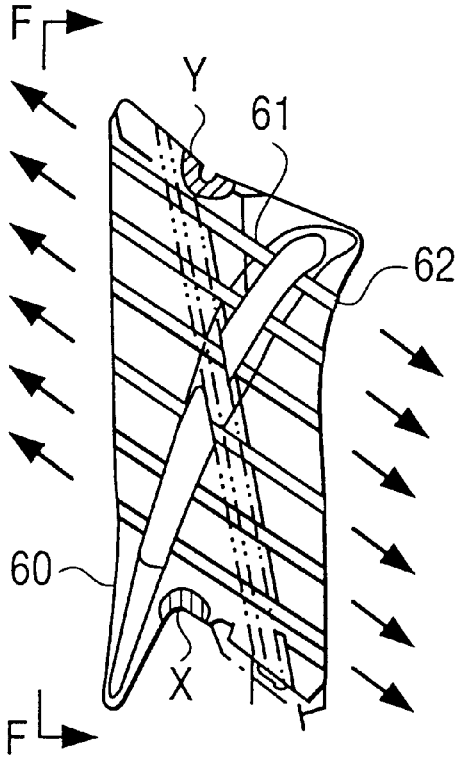
FIG. 7(a) (PRIOR ART)
FIGS. 7(*a*)–7(*b*) show the tip shroud of the gas turbine moving blade shown in FIG. 6(*a*), FIG. 7(*a*) is a view taken in the direction of arrows E—E of FIG. 6(*a*), and FIG. 7(*b*) is a view taken in the direction of arrows F—F of FIG. 7(*a*)
Figure 7B:
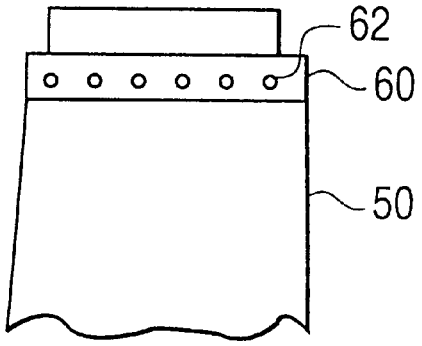
FIG. 7(b) (PRIOR ART)
Figure 8:
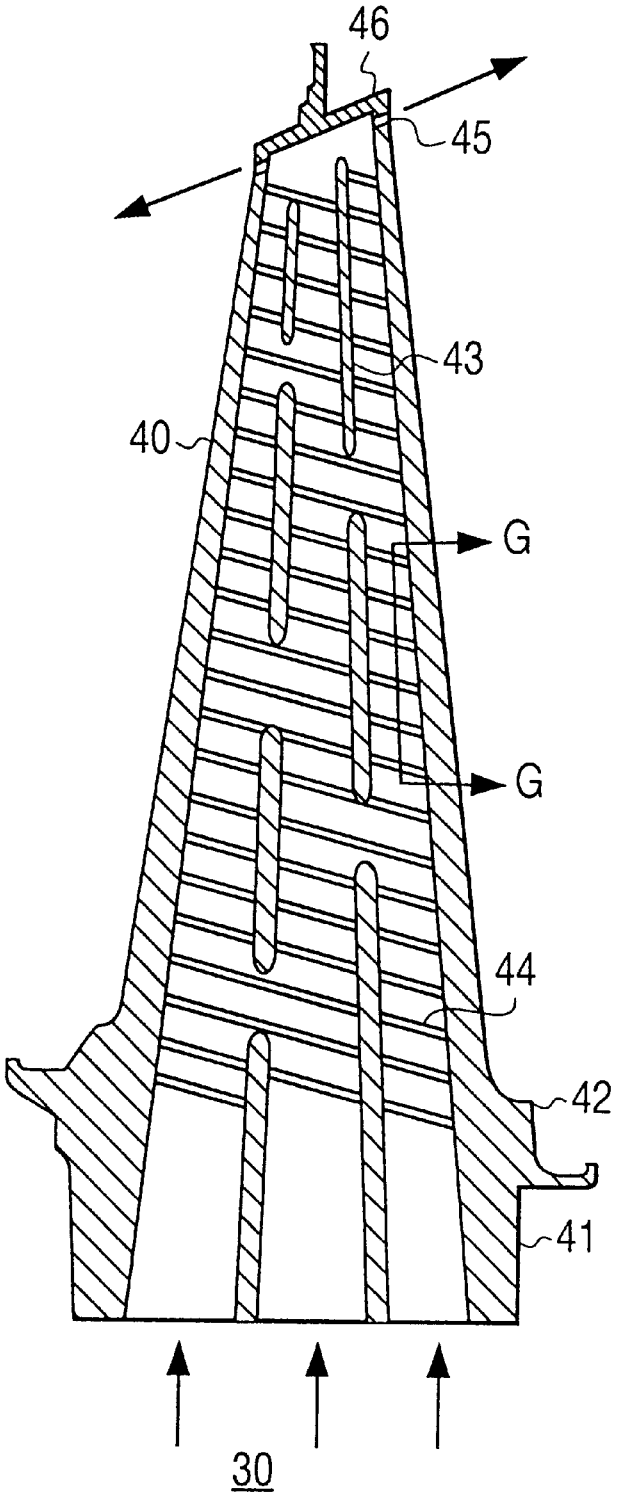
FIG. 8 (PRIOR ART)
FIG. 8 is a longitudinal section of a gas turbine moving blade according to a technique developed prior to the present invention and provided with inclined turbulators.
Figure 9:
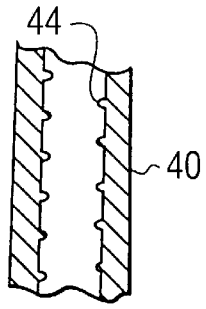
FIG. 9 (PRIOR ART)
FIG. 9 is a section taken in the direction of arrows G—G of FIG. 8.
Figure 10:
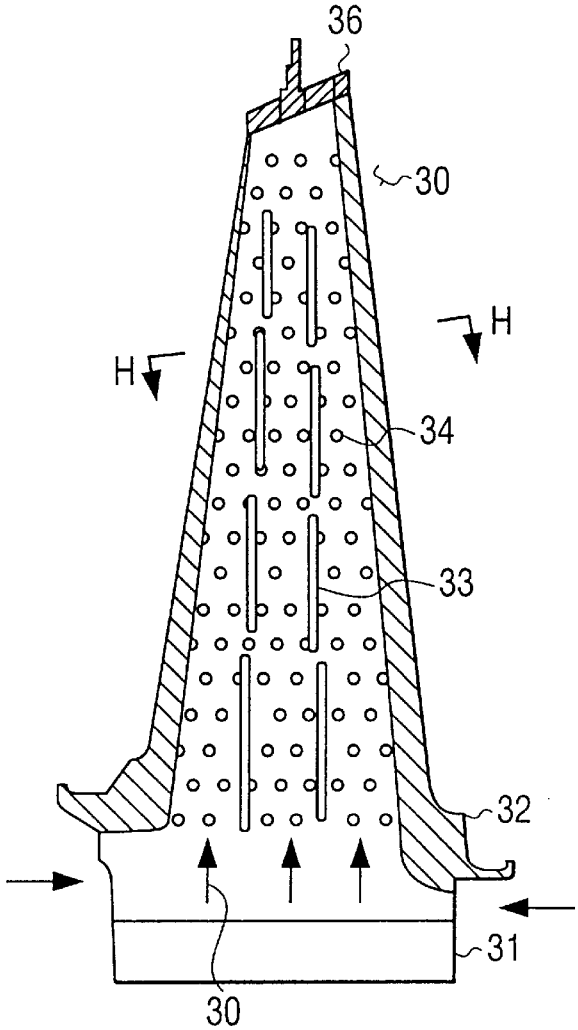
FIG. 10 (PRIOR ART)
FIG. 10 is a longitudinal section of a gas turbine moving blade according to a technique developed prior to the present invention and provided with pin fins.
Figure 11:
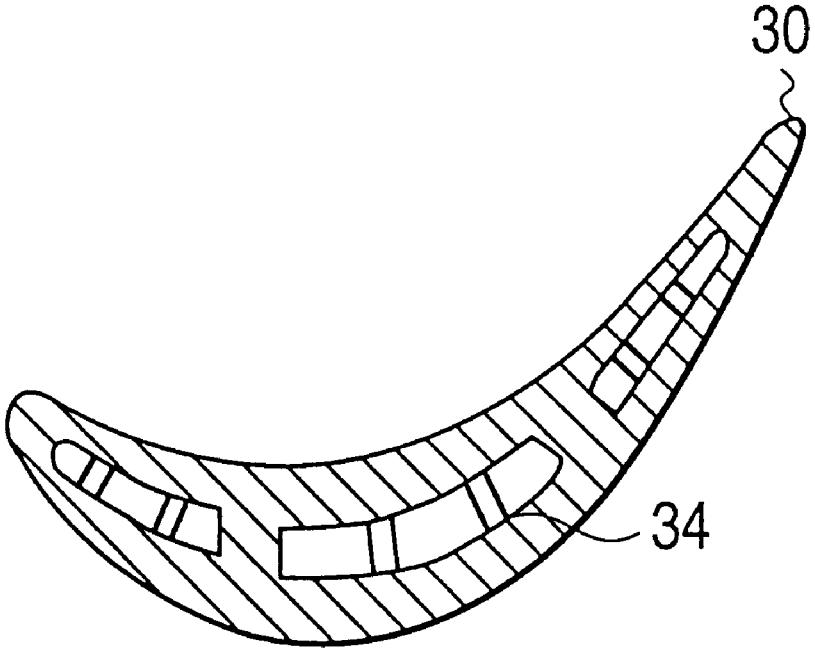
FIG. 11 (PRIOR ART)
FIG. 11 is a section taken in the direction of arrows H—H of FIG. 10.

Here, the cooled blade tip shroud in the embodiment of the invention thus far described can be applied with similar effects as the tip shroud of any of the moving blade 50 of the prior art having the pin fins 56 and the multi-holes 58, as described with reference to FIG. 6, the moving blade 40 having only the inclined turbulator 44, as shown in FIG. 8, and the moving blade 30 having only the pin fins 34, as shown in FIG. 10.

Figure 4:
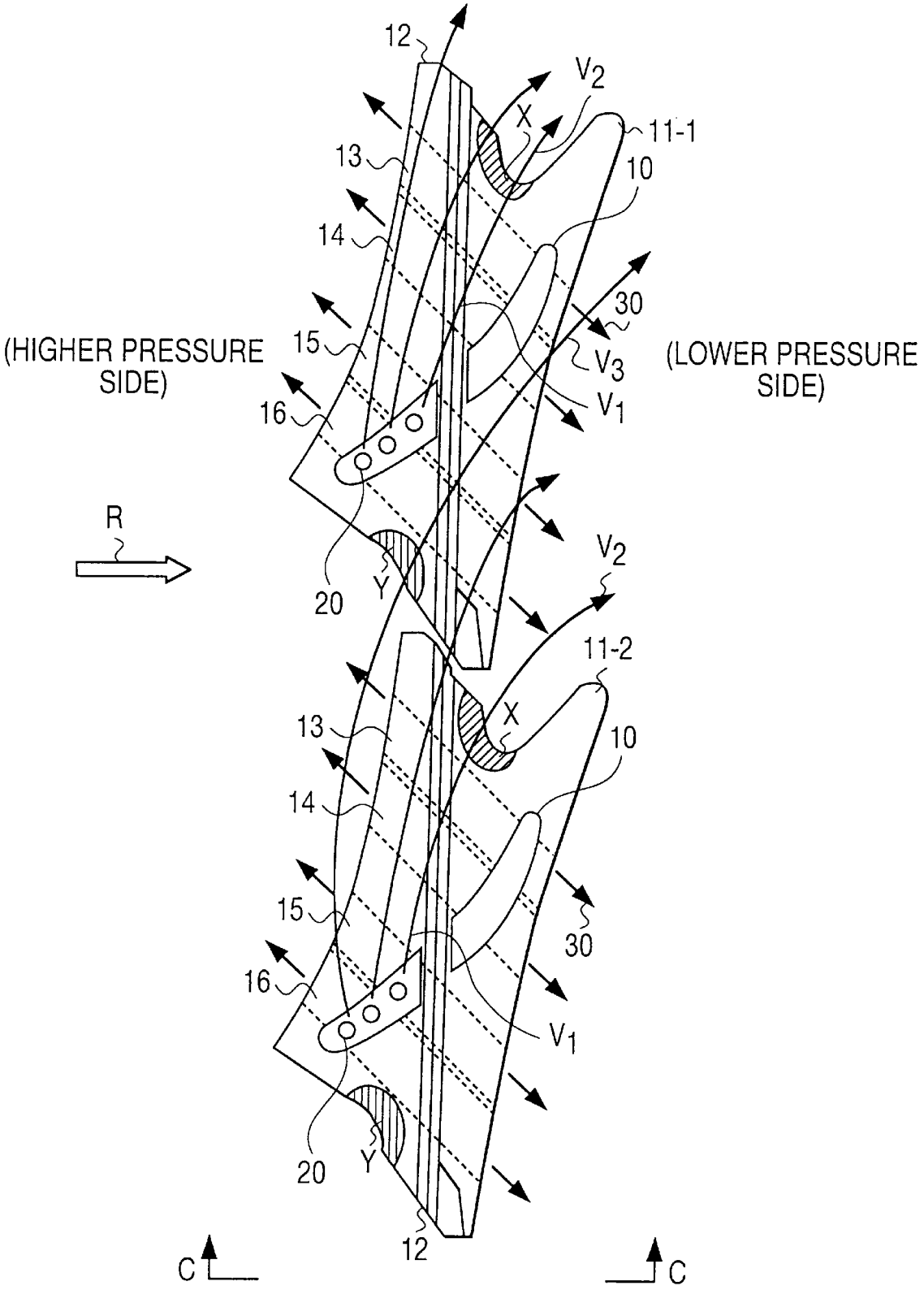
FIG. 4 is a diagram showing the gas turbine cooled blade tip shroud according to the embodiment of the invention and explaining its actions.
Figure 5:
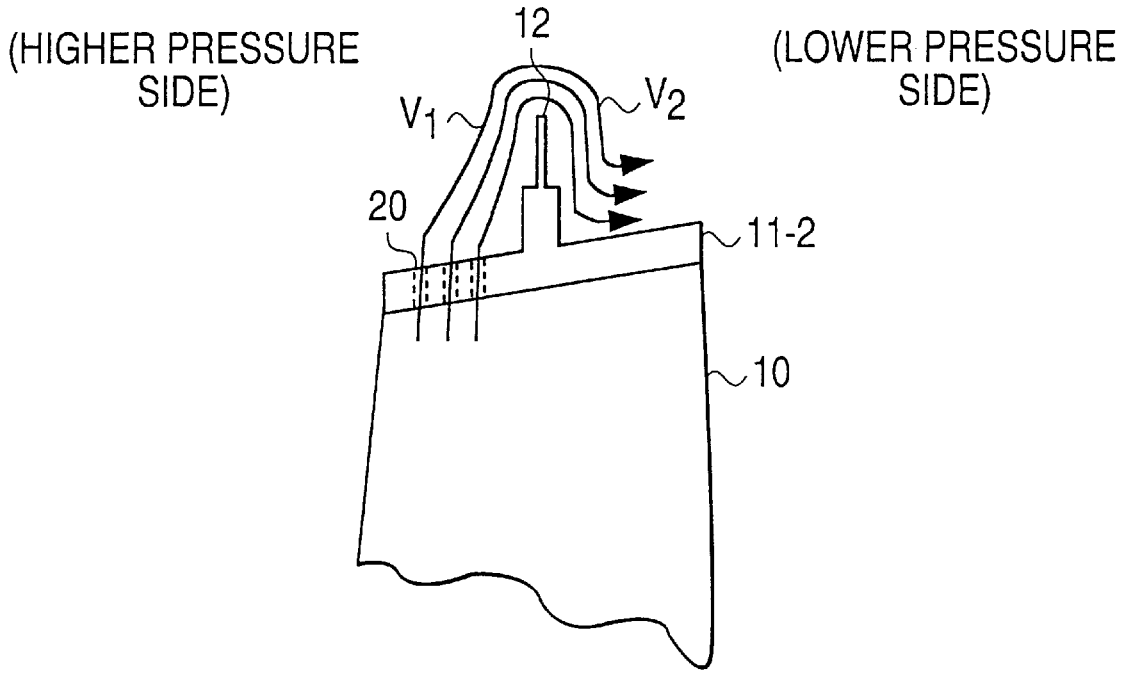
FIG. 5 is a view taken in the direction of arrows C—C of FIG. 4.

Here will be described the actions of the gas turbine cooled blade tip shroud of the aforementioned embodiment. FIG. 4 is a top plan view of the tip shroud for explaining the actions and shows tip shrouds 11-1 and 11-2 circumferentially adjoining each other. FIG. 5 is a view taken in the direction of arrows C—C of FIG. 4 and shows the flows of the cooling air over the shroud surface.

In FIG. 4, the tip shrouds 11-1 and 11-2 are circumferentially arranged adjacent to each other so that the cooling air 30 from the moving blade 10 passes the slot-shaped cooling air holes 13 to 16 while cooling the inner sides of the tip shrouds 11-1 and 11-2, until it finally flows from the individual two side faces to the combustion gas passage.

From the cooling air holes 20, formed in the upper faces of the tip shrouds 11-1 and 11-2 on the higher pressure side with respect to the combustion gas flow direction R, the cooling air from the moving blade 10 flows out to the surfaces of the tip shrouds 11-1 and 11-2. Since the cooling air flows out to the higher pressure side in the combustion gas flow direction R, however, it is forced by the gas flow to a lower pressure side, as indicated by V1, and further to the downstream side, as indicated by V2, over the fin 12. As to a portion of the cooling air V1 to flow out to the lower pressure side in connection with the tip shroud 11-1, the cooling air flows V1 and, V2, having passed the fin of the tip, cool the surface of the high stress portion X, and a cooling air flow V3, from the tip shroud 11-2, flows while cooling the surface of a high stress portion Y on the higher pressure side of the tip shroud 11-1. Of the high stress portions X and Y of the tip shroud 11-1, therefore, the high stress portion Y is cooled with the cooling air flow V1 of its own cooling air holes 20, and the high stress portion X is cooled with the cooling air flow V3 from the adjoining tip shroud thereby to effect the cooling operation.

FIG. 5 is a view taken in the direction of arrows C—C of FIG. 4 and shows the cooling air flow over the upper face of the tip shroud 11-2. As shown, the cooling air flows from the inside of the moving blade 10 via the cooling air holes 20 of the tip shroud 11-2 to the higher pressure side of the combustion gas flow so that it is guided by the pressure difference to flow over the fin 12, as indicated by the flows V1 to V2, along the upper face of the tip shroud 11-2 to the lower pressure side. Even when the pressure for feeding the cooling air is low, therefore, the high stress portions X and Y can be fed with the cooling air due to the pressure difference over the upper face of the tip shroud.

In the gas turbine cooled blade tip shroud thus far described according to the embodiment of the invention, the slot-shaped cooling air holes 13 to 16 that are opened in the two side faces are provided in the tip shroud 11, and the cooling air holes 20 communicating with the inside of the moving blade 10 are formed in the upper face of the tip shroud 11 on the higher pressure side (or upstream side) in the gas flow direction. As a result, the tip shroud 11 is passed therethrough over a wide area by the cooling air to enhance the cooling effect, and the high stress portions X and Y of the tip shroud 11 are also exposed through the cooling air holes 20 to the cooling air outside of the upper face thereof so that they are effectively cooled to prevent a high stress from occurring. Therefore, the high stress portions X and Y of the tip shroud 11, which cannot be worked to form the cooling air holes, can be fed with the cooling air by making use of the pressure difference at the upper face.

What is claimed is:

1. A gas turbine moving blade assembly comprising:

a moving blade having a blade root and an outer end portion;

a blade shroud mounted on the outer end portion of said moving blade, said blade shroud having opposite side faces and a plurality of cooling air holes formed in the side faces for receiving cooling air from the blade root and releasing the cooling air through said cooling air holes, wherein each of said cooling air holes that are formed in said side faces has an elongated slot shape.

2. A gas turbine moving blade assembly comprising:

a moving blade having a blade root and an outer end portion; and a tip shroud mounted on the outer end portion of said moving blade, said tip shroud having opposite side faces, an outer face, a plurality of cooling air holes formed in the side faces, and a plurality of cooling air holes formed in the outer face of said tip shroud, wherein said cooling air holes, formed in the outer face of said tip shroud, communicate with the interior of said moving blade and are positioned on a higher pressure side of a combustion gas passage, and wherein said cooling air holes, formed in the outer face of said tip shroud, are positioned only on an upstream side of said tip shroud relative to the flow of combustion gas in the combustion gas passage.

3. A gas turbine moving blade assembly as claimed in claim 2, wherein said cooling air holes, formed in the outer face of said tip shroud, are positioned only on an upstream side of said tip shroud relative to the flow of combustion gas in the combustion gas passage.

4. A gas turbine moving blade assembly comprising:

a moving blade having a blade root and an outer end portion; and a tip shroud mounted on the outer end portion of said moving blade, said tip shroud having opposite side faces, an outer face, a plurality of cooling air holes formed in the side faces, and a plurality of cooling air holes formed in the outer face of said tip shroud wherein said cooling air holes, formed in the outer face of said tip shroud, communicate with the interior of said moving blade And are Positioned on a higher pressure side of a combustion gas passage, wherein each of said cooling holes, formed in the side faces of said tip shroud, communicate with the interior of said moving blade and have an elongated elliptical shape so as to release cooling air over a wide area of said tip shroud.

5. A gas turbine cooled blade tip shroud for being mounted on an outer end of a moving blade, said gas turbine cooled blade tip shroud having an upstream side face, a downstream side face, an upper face, a plurality of elongated elliptical holes formed in said upstream side face for communicating with an interior of the moving blade, a plurality of elliptical holes formed in said downstream side face for receiving cooling air from the interior of the moving blade, and a plurality of cooling holes formed in said upper face for receiving cooling air from the interior of the moving blade, wherein said cooling holes, formed in said upper face, are positioned on a higher-pressure side of a combustion gas passage.

* * * * *